US010801323B2

(12) United States Patent
Kennedy et al.

(10) Patent No.: US 10,801,323 B2
(45) Date of Patent: Oct. 13, 2020

(54) MINE STOPPING AND COMPONENTS THEREOF

(71) Applicant: Jack Kennedy Metal Products & Buildings, Inc., Taylorville, IL (US)

(72) Inventors: William R. Kennedy, Taylorville, IL (US); John M. Kennedy, Taylorville, IL (US)

(73) Assignee: Jack Kennedy Metal Products & Buildings, Inc., Taylorville, IL (US)

( * ) Notice: Subject to any disclaimer, the term of this patent is extended or adjusted under 35 U.S.C. 154(b) by 0 days.

(21) Appl. No.: 16/370,170

(22) Filed: Mar. 29, 2019

(65) Prior Publication Data

US 2019/0301284 A1 Oct. 3, 2019

Related U.S. Application Data

(60) Provisional application No. 62/650,753, filed on Mar. 30, 2018.

(51) Int. Cl.
*E21F 1/14* (2006.01)
*E21F 17/103* (2006.01)

(52) U.S. Cl.
CPC ..... *E21F 17/103* (2013.01); *E21F 1/14* (2013.01)

(58) Field of Classification Search
CPC ... E21F 17/103; E21F 1/14; E21F 1/10; E21F 15/00; E01F 13/046; E01F 13/048; E04H 17/14
See application file for complete search history.

(56) References Cited

U.S. PATENT DOCUMENTS

| | | | | |
|---|---|---|---|---|
| 2,729,065 | A * | 1/1956 | Craggs | E21F 17/103 405/132 |
| 4,483,642 | A | 11/1984 | Kennedy et al. | |
| 4,484,837 | A | 11/1984 | Kennedy et al. | |
| 4,547,094 | A | 10/1985 | Kennedy et al. | |
| 4,695,035 | A | 9/1987 | Kennedy et al. | |
| RE32,675 | E | 5/1988 | Kennedy et al. | |
| RE32,871 | E | 2/1989 | Kennedy et al. | |
| 4,820,081 | A | 4/1989 | Kennedy et al. | |
| 4,915,540 | A | 4/1990 | Kennedy et al. | |
| RE34,220 | E | 4/1993 | Kennedy et al. | |
| 5,588,786 | A * | 12/1996 | House | E01F 8/0011 405/284 |
| 6,220,785 | B1 | 4/2001 | Kennedy et al. | |
| 6,379,084 | B1 | 4/2002 | Kennedy et al. | |
| 6,419,324 | B1 | 7/2002 | Kennedy et al. | |
| 6,457,906 | B1 | 10/2002 | Kennedy et al. | |
| 6,682,263 | B2 | 1/2004 | Kennedy et al. | |
| 6,688,813 | B2 | 2/2004 | Kennedy et al. | |
| 6,715,961 | B2 | 4/2004 | Kennedy et al. | |
| 6,846,132 | B2 | 1/2005 | Kennedy et al. | |
| 7,267,505 | B2 | 9/2007 | Kennedy et al. | |
| 7,438,506 | B2 | 10/2008 | Kennedy et al. | |
| 9,447,684 | B2 | 9/2016 | Kennedy et al. | |
| 10,151,203 | B2 | 12/2018 | Kennedy et al. | |
| 10,287,884 | B2 | 5/2019 | Kennedy et al. | |
| 2003/0082010 | A1 | 5/2003 | Kennedy et al. | |
| 2003/0147706 | A1 * | 8/2003 | Kennedy | E21F 1/10 405/288 |
| 2015/0260041 | A1 | 9/2015 | Kennedy et al. | |

* cited by examiner

*Primary Examiner* — Sean D Andrish
(74) *Attorney, Agent, or Firm* — Stinson LLP

(57) ABSTRACT

A mine stopping and associated components and methods. The stopping can include one or more columns or other vertical supports and a plurality of elongate panels extending horizontally.

27 Claims, 4 Drawing Sheets

MINE STOPPING AND COMPONENTS THEREOF

CROSS-REFERENCE TO RELATED APPLICATION

This application claims priority to U.S. Provisional Patent Application Ser. No. 62/650,753 filed on Mar. 30, 2018, the disclosure of which is incorporated herein by reference in its entirety.

FIELD

The present disclosure relates to mine ventilation equipment and more particularly to a mine stopping which is especially adapted for low seam height mines.

BACKGROUND

Mine stoppings are widely used in mines to impede or stop the flow of air in mine passages. Examples of prior mine stoppings are described in U.S. Pat. Nos. 4,483,642, 4,484,837, 4,547,094, 4,820,081, and 9,447,684 assigned to Jack Kennedy Metal Products & Buildings, Inc. Such stoppings are formed by a plurality of elongate metal panels that extend vertically in side-by-side relation from floor to roof across the width of the mine passage. Some mine passages can be quite large, e.g., 20 feet wide and 10 feet high and even as large as 60 feet wide and 35 feet high. In other mines where the seam to be mined is relatively thin, the height of the mine passage is much less. In these mines, the installation of metal stoppings made of vertical panels is less efficient and cost effective.

SUMMARY

In one aspect, a mine stopping is installed in a mine passage having a roof, a floor, and opposite first and second side ribs. The mine stopping includes at least one vertical column extending from the floor to the roof. The mine stopping also includes rows of elongate horizontal panels supported one row above another row by the at least one column to extend horizontally between the first and second side ribs to form a wall. The wall of elongate horizontal panels extends substantially completely across the mine passage between the opposite first and second side ribs.

In another aspect, an elongate panel is adapted for installation in a mine passage having a roof, a floor, and opposite side ribs. The elongate panel is adapted to be installed in a generally horizontal position extending between the opposite side ribs. The elongate panel includes a web having upper and lower edges, and a flange extending laterally from the web along one of the upper and lower edges. The web has no flange along the other of said upper and lower edges thereby to allow the web of the elongate panel to lie closely adjacent a web of another elongate panel installed in a horizontal position in said mine passage. The elongate panel includes two elongate panel members having a telescoping fit allowing adjustment of a length of the elongate panel.

In yet another aspect, a column is for use in constructing a mine stopping in a mine passage having a roof, a floor, and opposite side ribs. The column includes a column body including a lower column member and an upper column member. The upper column member is extendable relative to the lower column member to bring lower and upper ends of the column body into pressing engagement with the respective floor and roof of the mine passage. The column includes a system associated with the column body constructed to support a plurality of panels extending horizontally between the opposite side ribs of the mine passage.

Other objects and features of the present disclosure will be in part apparent and in part pointed out herein.

BRIEF DESCRIPTION

Corresponding reference characters indicate corresponding parts throughout the several views of the drawings.

DETAILED DESCRIPTION

Figure 1:
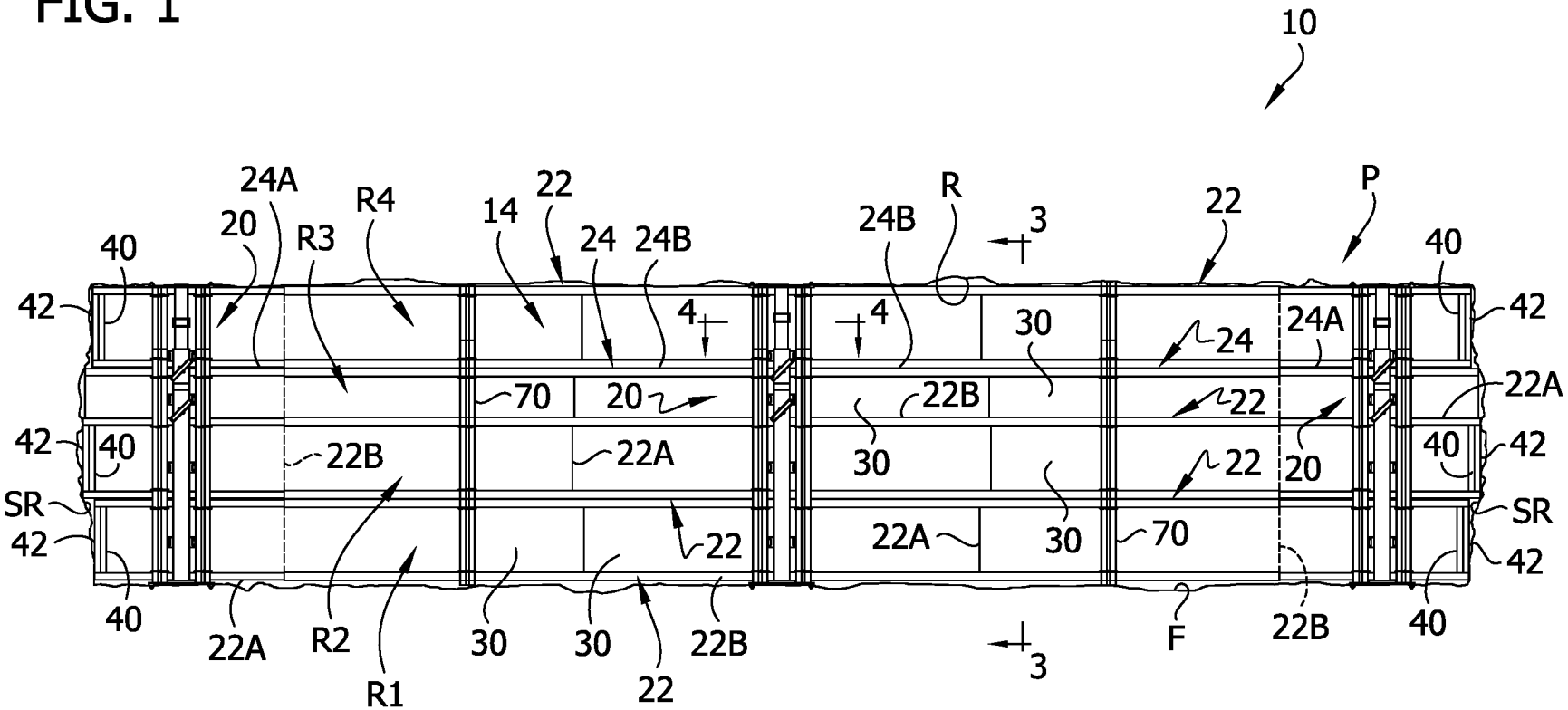
FIG. 1 is a front elevation of one embodiment of a mine stopping of the present disclosure installed in a mine passage.
Figure 2:
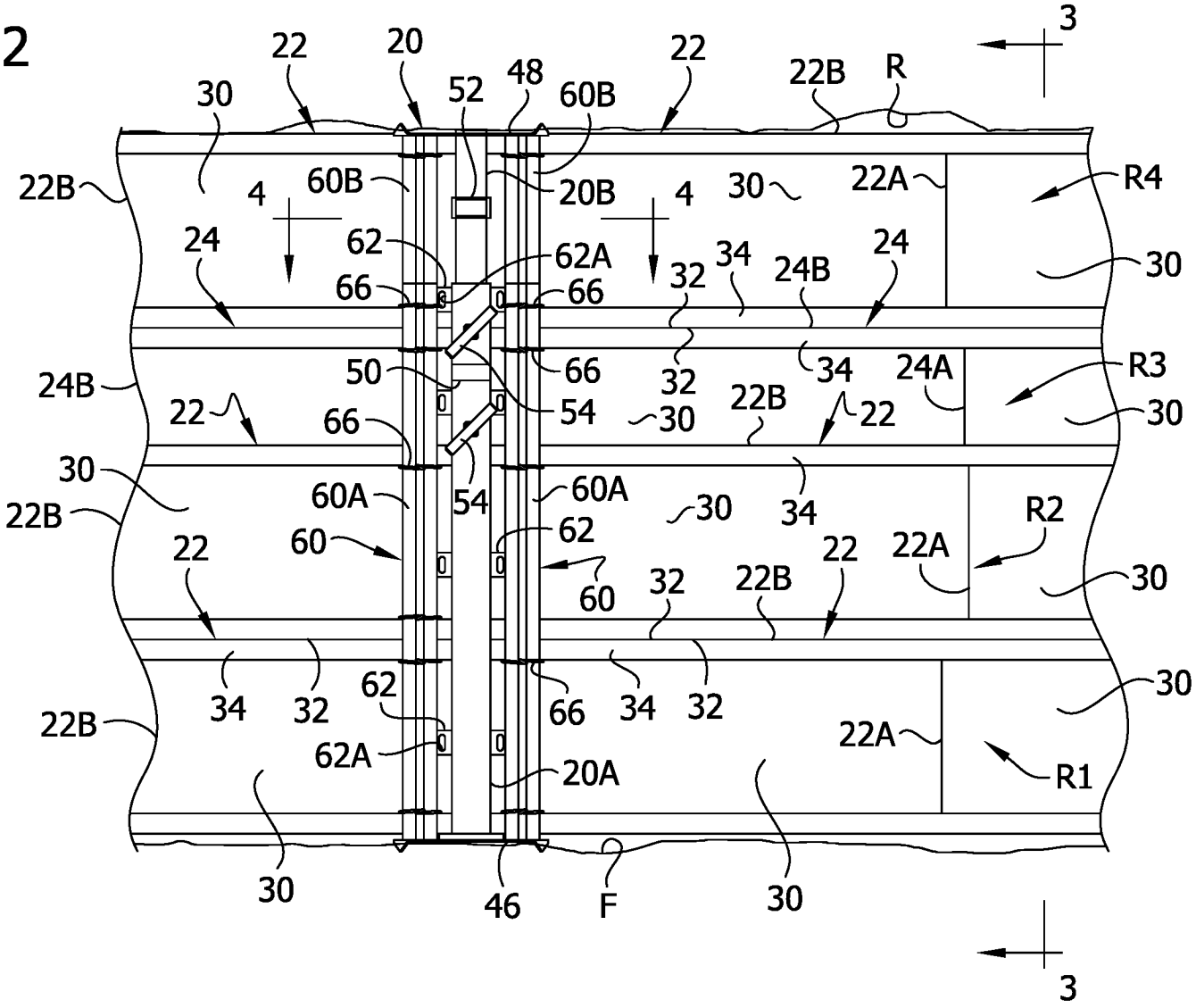
FIG. 2 is an enlarged portion of FIG. 1 showing details of a center column of the stopping.

Referring to FIG. 1, the numeral 10 generally designates a mine stopping system installed in a mine passage P having a floor F, roof R, and opposite side ribs SR. The stopping 10 can be used to substantially or partially seal the passage P against air flow therethrough. In the embodiment shown in FIG. 1, the stopping 10 is used to substantially seal against air flow creating a pressure differential across the stopping 10 with a front, normally high pressure side 12 and a rear, normally low pressure side 14. This pressure differential applies force to the stopping 10 in the direction of the higher pressure side 12 toward the lower pressure side 14. It is to be understood that in operation the higher pressure side 12 and the lower pressure side 14 may switch under certain circumstances but are normally in one orientation.

The stopping 10, in the embodiment shown, includes three columns 20 extending from floor F to roof R at spaced intervals across the mine passage P. It will be understood that the number of columns 20 may vary from at least one column to two or more columns, depending on the width of the passage P. The stopping 10 also includes a plurality of horizontal rows R1, R2, R3, and R4 of elongate panels supported on the columns 20 at locations one above another, the bottom row adjacent the floor being designated R1, the next row above it R2, and so forth. In the illustrated embodiment, the panels in rows R1, R2, and R4 are of substantially identical construction (although they may vary in length). Each panel of this first type is generally designated 22. The panels in row R3 are of a different construction described hereinafter, and each panel of this second type is generally designated 24. The rows R1-R4 of panels 22, 24 extend horizontally between the side ribs SR of the mine passage P to form a wall of horizontal panels that extends substantially completely across the mine passage and in which the rows of horizontal panels are stacked from adjacent the floor F to adjacent the roof R of the mine passage to substantially completely close the mine passage. The generally horizontal panels 22, 24 are supported at different elevations above the mine floor F by a support system on each column 20 generally designated 26. Walls having other configurations can be used without departing from the scope of the present invention.

In the embodiment of FIG. 1, each row R1, R2, R3, and R4 comprises two elongate horizontal panels 22, 24 disposed end-to-end, with adjacent ends of the panels of each pair substantially abutting at the center column 20 and their opposite ends positioned closely adjacent respective side ribs SR of the mine passage P. The panels 22, 24 on opposite sides of the center column 20 can be out of register with one another yet still form rows that extend across the mine passage P. The number of rows and number of panels 22, 24 in each row will vary depending on the dimensions of the mine passage P. For example, in a wider mine passage, each row can include an intermediate panel having opposite ends abutting respective ends of panels extending from the intermediate panel to the opposite side ribs. Moreover, in a narrower mine passage, only the left or right set of panels may be required to span the distance between the opposite side ribs of the mine passage, in which case perhaps only one column is used at an intermediate position between the ends of the panels.

In general, each horizontal panel 22 of the first type in rows R1, R2 and R4 comprises two panel members 22A, 22B having a telescoping fit with one another to allow adjustment of the length of the panel along a horizontal axis. The panel members 22A, 22B may be formed from sheet metal, for example. In the illustrated embodiment, the panel members are generally of channel-shape in vertical cross section (see FIG. 3), each having a vertical web 30 and upper and lower side flanges 32 extending laterally from the web along respective upper and lower edges of the web. As illustrated, the panel member 22A is nested inside the panel member 22B with the webs 30 of the panel members positioned adjacent one another. In the illustrated embodiment, the flanges have in-turned lips 34 at the outer edges of the flanges and the in-turned lips have edge margins 36 bent back toward the web 30 in a direction generally parallel to the flanges 32. Reference may be made to co-assigned U.S. Pat. No. 9,447,684, for a more detailed description of panel members having this type of construction. Alternatively, one flange of each panel member may be turned outward, as described in more detail in co-assigned U.S. Pat. No. 7,267,505. Both of these patents are hereby incorporated by reference herein. Although not shown herein, each edge margin 36 could have a portion folded back on itself to provide a "hemmed" edge.

Figure 4:
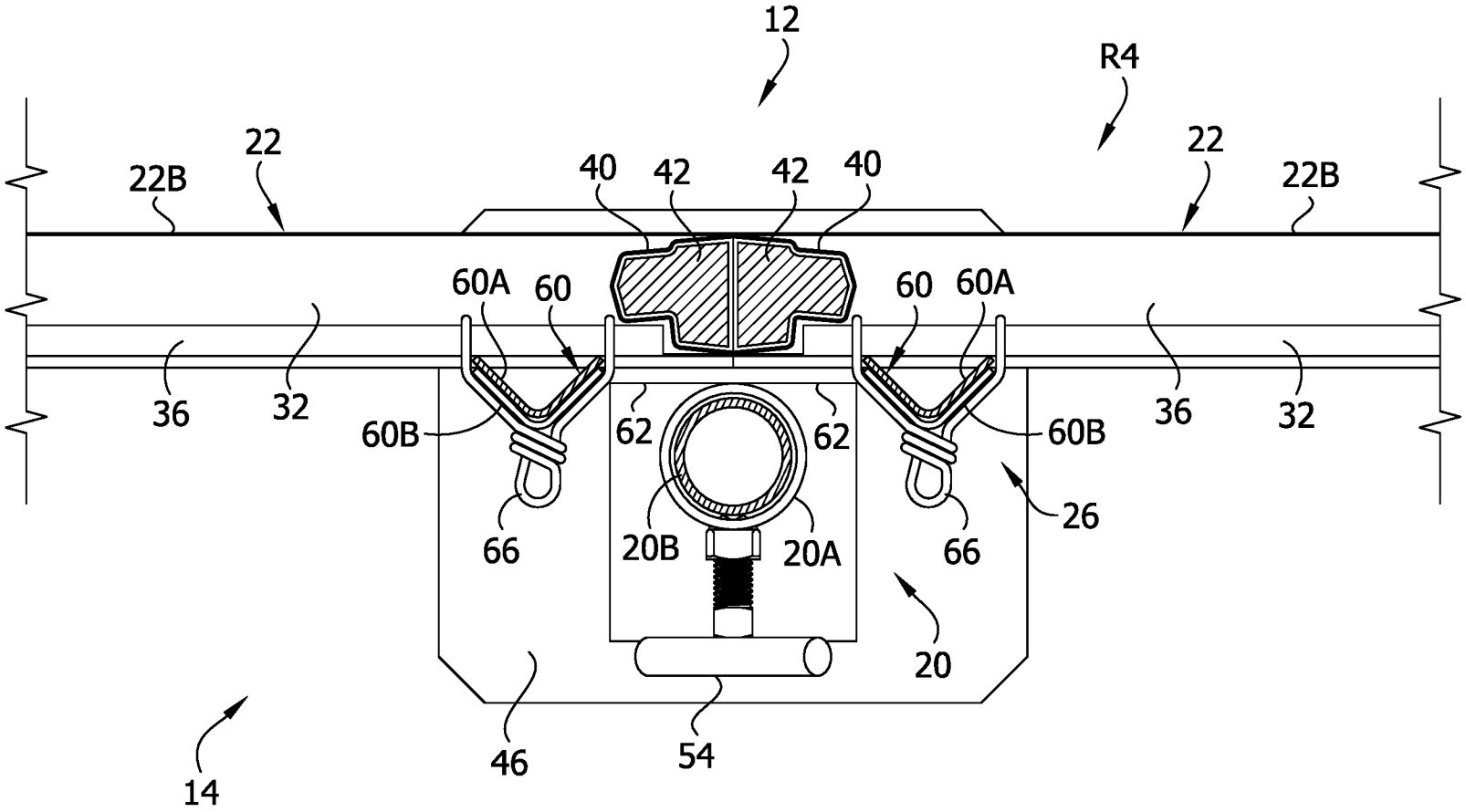
FIG. 4 is a sectional view of the stopping taken along the line 4-4 of FIG. 1.

Each panel 22 of the first type also includes end caps 40 located at opposite ends of each panel. As shown best in FIGS. 1 and 4, each end cap 40 is received between the flanges 32 of the respective panel member and is secured to the panel by welding, louver connections, or other suitable means, such as more fully described in co-assigned U.S. Pat. No. 9,447,684, incorporated by reference above. Desirably, but not necessarily, the end caps 40 are configured to receive sealing members. For example, the end caps 40 in FIG. 4 are shown carrying sealing members 42 in pressing engagement with each other such that the sealing members are compressed and create a seal at the abutment of the ends of the panels 22 at the column 20. Sealing members 42 can also be provided at the other ends of the panels 22 for sealing engagement with the opposite side ribs SR of the mine passage P. Examples and other characteristics of suitable end caps and sealing members are disclosed in co-assigned U.S. Pat. No. 4,483,642, hereby incorporated by reference herein.

The horizontal panels 22 of the first type do not need to have the exact same construction as each other. However, the upper and lower elongate ends of the panels desirably are constructed to abut or be closely adjacent each other to facilitate making a seal between the panels.

Figure 3:
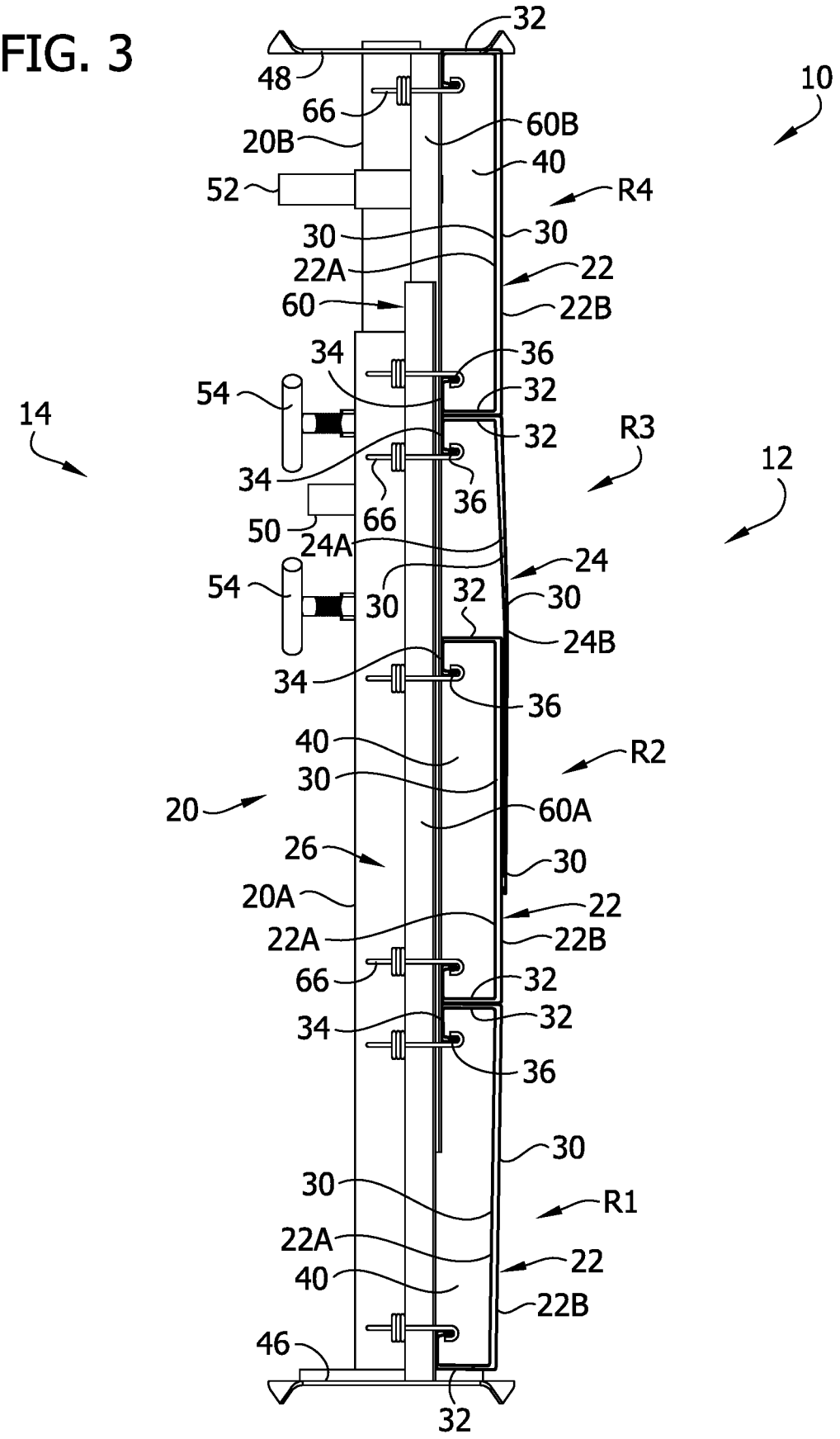
FIG. 3 is a sectional view of the stopping taken along the line 3-3 of FIG. 1.

As best illustrated in FIG. 3, the rows R1-R4 of panels 22, 24 are arranged in stacked relationship in which one row is above the other. For example, the lower flanges 32 of the panels 22 in row R1 are positioned on or closely adjacent the floor F of the mine passage P. The lower flanges 32 of the panels 22 in row R2 are positioned on or closely adjacent the upper flanges 32 of the panels in row R1. The upper flanges 32 of the panels 22 in row R4 are positioned on or closely adjacent the roof R of the mine passage P. The lower flanges 32 of the panels 22 in row R4 are positioned on or closely adjacent the upper flanges 32 of the panels in row R3. As described in more detail below, the panels 24 in row R3 are lapping panels, that is, they are constructed so that the webs 30 of these panels overlap the webs 30 of an adjacent row of panels. In the illustrated embodiment, the lower portions of the webs 30 of the panels 24 in row R3 overlap upper portions of the webs 30 of the channel-shaped panels 22 in row R2. It will be appreciated that the lapping panels 24 can be provided in other and/or additional rows and can be inverted to overlap a panel above the lapping panel rather than below the lapping panel.

Each lapping panel 24 in row R3 is similar to the panels 22 in rows R1, R3 and R4 with some exceptions. The lapping panels 24 are different in that the two telescoping panel members 24A, 24B of the lapping panel have no flanges along the lower edges of the webs 30 of the lapping panel members 24A, 24B. The web 30 of an elongate horizontal lapping panel 24 in row R3 lies closely adjacent (and desirably in flatwise contact with) the web 30 of the corresponding channel-shaped panel 22 in row R2 below such that the rear surface of the web of the elongate horizontal lapping panel seals against the front surface of the web of the overlapped channel-shaped panel. This overlapping arrangement allows a combination of the panels 22, 24 to readily fit the height of any mine passage P while minimizing the gaps between the panels. Further, the overlap of the panels 22, 24 allows the panels in rows R4 and R3 to move downward or the panels in rows R1 and R2 to move upward to accommodate mine convergence (i.e., movement of the roof and floor toward one another) without damage to the wall. The lapping panels 24 are also different from the channel-shaped panels 22 in that the lapping panels have no end caps with seals, although suitable end caps and/or seals could be provided. Desirably, the lapping panels 24 have webs 30 of greater height than the webs 30 of the channel-shaped panels 22. The lapping panels 24 can be made using the same sheet metal blanks as used to form the channel-shaped panels 22. Because one of the elongate edge margins of the lapping panel 24 is not bent to form a second flange, the web 30 has a greater dimension between the free edge and the edge having the flange 32.

Lapping panels having other constructions can be used without departing from the scope of the present invention. For example, although the web 30 of the lapping panel in the illustrated example is planar, discontinuities could be provided in the web. Moreover, the web could be bowed to define a generally concave rear surface of the web on the side of the flange 30. Further, the height of the web could be equal to or less than the height of a channel-shaped panel. Other arrangements are possible.

In the illustrated embodiment, each column 20 is a telescoping column having a column body comprising lower and upper column members 20A, 20B telescopically fitted relative to one another, e.g., an upper steel tube telescoped inside a lower steel tube. The lower column member 20A has a lower anchor plate 46 affixed to its lower end for engagement with the floor F of the mine passage P, and the upper column member 20B has an upper anchor plate 48 affixed to its upper end for engagement with the roof R of the mine passage. The upper column member 20B is extendable by a jack or other suitable means to move into pressure engagement with the roof R of the mine passage P. By way of example but not limitation, an hydraulic bottle jack may be positioned between a loop 50 on the lower column member 20A and a lifting collar 52 on the upper column member 20B and activated for this purpose. One or more set screws 54 are provided to lock the column members 20A, 20B relative to one another after they have been jacked into position.

In the illustrated embodiment, the support system 26 on each column 20 comprises a pair of elongate vertical supports 60 affixed (e.g., welded) to ears 62 projecting laterally from the column at opposite sides of the column members 20A, 20B. Each elongate support 60 comprises a lower elongate support member 60A affixed to three ears 62 on the lower column member 20A and an upper elongate support member 60B affixed to one ear 62 on the upper column member 20B. The lower elongate support member 60A could also be affixed to the lower anchor plate 46, and the upper elongate support 60B could also be affixed to the upper anchor plate 48. The elongate support members 60A, 60B have a telescoping fit with one another to allow vertical adjustment of the length of the support 60 as the column 20 extends (as during installation of the column) and contracts (as during a mine convergence). In the illustrated embodiment, the elongate support members 60A, 60B are angle bars nested one inside the other. Other configurations are possible. The horizontal panels 22, 24 are secured to the support members 60A, 60B by clamps 66 comprising, in this embodiment, wire twist clamps described in detail in co-assigned U.S. Pat. No. 4,483,642 incorporated by reference above. This type of wire twist clamp 66 is used to secure the lips 34 of the channel-shaped panels 22 and the lapping panels 24 against the support members 60A, 60B. An elongate vertical opening 62A is provided in each ear 62 to permit one leg of a twist clamp 66 to be inserted through the opening in the event the clamp position coincides with the ear. Without the opening 62A, if the clamp position coincided with an ear 62 an installer would be forced to move the panel 22, 24 up or down somewhat to allow installation of the clamp 66, thus creating an undesirable gap with respect to an adjacent panel.

Other types of columns can be used without departing from the scope of the present invention. For example, other types of column bodies and/or vertical supports could be used. Moreover, connectors other than wire twist clamps could be used.

An exemplary process for installing the mine stopping 10 is described as follows:

1. Select a site along the intended entry that is the most advantageous and has the most true roof R and floor F.

2. Install the columns 20. Each column 20 is telescopically extended to achieve heavy roof-to-floor pressure by using, for example, a hydraulic jack. The set screws 54 are then tightened to secure the column members 20A, 20B relative to one another.

3. Install the horizontal panels 22 in row R1, with the inner ends of the two panels abutting one another at the center column 20. A channel or other support (not shown) may be provided on the column 20 for temporarily supporting the inner ends of the two panels 22. Slide the outer panel members 22A of the panels outward until they contact the respective side ribs SR of the passage P, and then clamp the panel members 22A, 22B of the panels 22 to respective vertical supports 60 on the columns 20.

4. Install the remaining horizontal panels 22 of row R2 similarly by stacking them on the previously installed panels 22 of row R1, the lower flanges of the panels in row R2 being positioned closely adjacent or in contact with the upper flanges of the panels in row R1.

5. Similarly install the horizontal panels of row R4 against the roof R.

6. Install the lapping panels 24 in row R3 to cover the resulting opening (gap) between the panels 22 in rows R2 and the roof panels 22 in row R4. The upper flanges 32 of the lapping panels 24 in row R3 should be closely adjacent or in contact with the lower flanges 32 of the panels in row R4.

7. Seal the gaps between the panels 22, 24 and the gaps between the panels and surrounding mine passage surfaces F, R, SR with appropriate sealant such that the wall is virtually air tight.

It will be understood that the columns 20 do not necessarily have to be in line between the side ribs SR of the mine passage P. The stopping 10 can have a vee shape or other shape in which the left and right sides of the wall are not in alignment with each other.

Optionally, the installation process can include the step of telescopically extending the horizontal panels 22 against one or both of the mine passage side ribs SR using a conventional stopping installation jack such as disclosed in co-assigned U.S. Pat. Nos. 4,695,035 and 7,438,506, hereby incorporated by reference herein. If this is desired, the outer columns 20 and/or one or more intermediate vertical supports 70 (see FIG. 1) are provided at one or more intermediate locations along the lengths of the horizontal panels 22, i.e., at locations between the center column and the outer columns or between the center column and the side ribs if there are no outer columns. Each vertical support 70 may comprise two elongate support members having a telescoping fit allowing vertical adjustment of the length of the support. By way of example but not limitation, the support members may be nested angle bars nested similar to the angle bars 60A, 60B. Wire twist clamps 66 or other suitable devices are applied to secure the horizontal panels to the one or more intermediate supports 70 to hold the inner and outer panel members 22A, 22B of each panel 22 against themselves to maintain the pressure against the side ribs SR created by the jack. This pressure against the side ribs SR may be desirable to help compress the sealing members 42 at the ends of the panels 22 against the mine passage ribs or to provide resistance against material sloughing from the ribs. However, the resistance of the wall to being pushed out by the air load is provided by the columns 20. Desirably, the connections of the panels 22, 24 to the vertical supports 70 by the twist clamps 66 provide high resistance to panel contraction to maintain the pressing engagement with the side ribs SR but permit contraction under high force due to pillar expansion or convergence of the side ribs SR toward each other to avoid damage to the stopping 10.

The stopping 10 described above has advantages over a stopping in which the panels are installed vertically. In this regard, vertical panels form a beam from the floor to the roof that resists the air load. If the panels are very short like those that would be appropriate for thin seams, they rapidly become "overkill" due to their structural shape. The strength of a uniformly loaded beam increases by the square of the reduction in length. That is, a panel that is half as long can handle four times as much air pressure. While somewhat thinner and lower yield strength material can be used in short panels, normal handling stresses during material moving and installation make a practical limit to that. In the horizontal design of the present invention, the panels 22, 24 span a distance that is much greater than the roof R to floor F height. This allows the efficient structural shape and normally handling resistant materials to be utilized more cost effectively than if the panels are installed vertically. Significantly less material is used.

Similarly, the horizontal panels 22, 24 require far fewer clamps 66 and associated installation labor. Further, instead of jacking many vertical panels in place as required in a vertical panel stopping, only a relatively few columns 20 are jacked in place. These features plus the drastically reduced amount of pieces and hardware contributes to a significantly less laborious installation.

It will also be noted that the lapping panels 24 are very much like the channel-shaped panels 22, which facilitates the manufacture and installation of the panels.

It will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A mine stopping installed in a mine passage having a roof, a floor, and opposite first and second side ribs, said mine stopping comprising at least one vertical column having a height and extending from the floor to the roof, rows of elongate horizontal panels supported one row above another row by the at least one vertical column to extend horizontally between the first and second side ribs to form a wall, said wall of elongate horizontal panels extending substantially completely across the mine passage between the first and second side ribs, and fasteners at vertically spaced apart locations along the height of the at least one vertical column, the fasteners connecting the rows of elongate horizontal panels to the at least one vertical column such that the fasteners support the rows of elongate horizontal panels one row above another row on the at least one column.

2. The mine stopping of claim 1, wherein the elongate horizontal panels are telescoping panels, each telescoping panel comprising two elongate horizontal panel members having a telescoping fit allowing adjustment of a length of the telescoping panel along a horizontal axis.

3. The mine stopping of claim 2, wherein said telescoping panels comprise first and second types of panels, each panel of the first type being a generally channel-shaped panel comprising a vertical web having upper and lower edges, and upper and lower flanges extending laterally from the web along the respective upper and lower edges of the web.

4. The mine stopping of claim 3, wherein each panel of the second type of panels is a lapping panel comprising a vertical web with upper and lower edges and a lapping panel flange extending laterally from the web along one of the upper and lower edges, the lapping panel being positioned such that the web of the lapping panel vertically overlaps the web of one of the channel-shaped panels of the first type of panels.

5. The mine stopping of claim 4, wherein the lapping panel is positioned such that the lapping panel flange of the lapping panel abuts one of the upper flange and the lower flange of one of the channel-shaped panels of the first type of panels.

6. The mine stopping of claim 4, wherein the web of the lapping panel has no flange along the other of the upper and lower edges of the web of the lapping panel extending toward the web of said one of the channel-shaped panels such that the web of the lapping panel lies closely adjacent the web of said one of the channel-shaped panels and in face-to-face overlapping relation therewith.

7. The mine stopping of claim 1, wherein said elongate horizontal panels comprise first and second types of panels, each panel of the first type being a generally channel-shaped panel comprising a vertical web having upper and lower edges, and upper and lower flanges extending laterally from the web along the respective upper and lower edges of the web, and each panel of the second type being a lapping panel comprising a vertical web with upper and lower edges and a flange extending laterally from the web along one of the upper and lower edges, the lapping panel being positioned such that the web of the lapping panel vertically overlaps the web of one of the channel-shaped panels of the first type of panels.

8. The mine stopping of claim 7, wherein the web of the lapping panel has no flange along the other of the upper and lower edges of the web of the lapping panel extending toward the web of said one of the channel-shaped panels such that the web of the lapping panel lies closely adjacent the web of said one of the channel-shaped panels and in face-to-face overlapping relation therewith.

9. The mine stopping of claim 1, wherein the fasteners comprise clamps.

10. The mine stopping of claim 1, wherein the at least one vertical column comprises a column body extending from the floor to the roof of the mine passage, and the at least one vertical column comprises at least one vertical support connected to the column body, and the fasteners secure the horizontal panels to the at least one vertical support.

11. The mine stopping of claim 10, wherein the at least one vertical support comprises an elongate vertical bar comprising two telescoping members allowing extension of the bar.

12. The mine stopping of claim 1, wherein the rows of elongate panels are positioned one row above the other such that rows of elongate panels span substantially completely a height of the mine passage from adjacent the floor of the mine passage to adjacent the roof of the mine passage.

13. The mine stopping of claim 1, wherein the at least one vertical column comprises an extendable vertical column including upper and lower column members, the upper column member being movable with respect to the lower column member to an extended position increasing a height of the extendable vertical column, and wherein the upper column member is secured in said extended position such that a lower end of the extendable vertical column and an upper end of the extendable vertical column are in pressing engagement with the respective floor and roof of the mine passage.

14. The mine stopping of claim 1, wherein a row of said rows of elongate horizontal panels includes a first elongate horizontal panel and a second elongate horizontal panel, the first elongate horizontal panel extending away from the first side rib of the mine passage toward the second elongate horizontal panel, the second elongate horizontal panel extending away from the second side rib of the mine passage toward the first elongate horizontal panel, the first and second elongate horizontal panels having adjacent ends in engagement with each other.

15. The mine stopping of claim 14, wherein said adjacent ends of the first and second elongate horizontal panels are in engagement with each other at said at least one vertical column.

16. The mine stopping of claim 1, wherein the elongate horizontal panels are telescoping panels, each elongate horizontal panel comprising two elongate horizontal panel members having a telescoping fit allowing adjustment of a length of the respective elongate horizontal panel along a horizontal axis, and wherein the at least one vertical column comprises at least one elongate vertical support, the at least one elongate vertical support located at an intermediate position with respect to ends of the elongate horizontal panels, at least one of the fasteners securing the two elongate horizontal panel members of each of the elongate horizontal panels to the at least one elongate vertical support to resist contraction of the two elongate horizontal panel members of each of the elongate horizontal panels relative to one another.

17. The mine stopping of claim 16, wherein the elongate panels each have at least one end in pressure engagement with a side rib of the mine passage.

18. The mine stopping of claim 16, wherein the at least one vertical column comprises a column body extending from the roof to the floor of the mine passage, and the at least one elongate vertical support is connected to the column body.

19. The mine stopping of claim 16, wherein the at least one elongate vertical support includes a segment to which the at least one of the fasteners secures the two elongate horizontal panel members, said segment being spaced laterally from the column body.

20. An elongate panel adapted for installation in a mine passage having a roof, a floor, and opposite side ribs, said elongate panel being adapted to be installed in a generally horizontal position extending between said opposite side ribs, said elongate panel comprising a web having upper and lower edges, and a flange extending laterally from the web along one of the upper and lower edges, said web having no flange along the other of said upper and lower edges that would prevent the web of the elongate panel to lie closely adjacent a web of another elongate panel installed in a horizontal position in said mine passage, wherein said elongate panel comprises two elongate panel members having a telescoping fit allowing adjustment of a length of the elongate panel.

21. A kit for constructing a mine stopping in a mine passage having a roof, a floor, and opposite side ribs, said kit including the elongate panel of claim 20, wherein said elongate panel is a first elongate panel, a plurality of second elongate panels adapted to be installed in a generally horizontal position extending between said opposite side ribs, the second elongate panels being generally channel-shaped panels each comprising a vertical web having upper and lower edges, and upper and lower flanges extending laterally from the web along the respective upper and lower edges of the web, and at least one column extendable into and securable in pressing engagement with the floor and roof of the mine passage, the at least one column adapted to support the first elongate panel and the plurality of second elongate panels in horizontal rows to form a wall of the elongate horizontal panels.

22. The kit of claim 21, wherein the second elongate panels are telescoping panels, each second elongate panel comprising two elongate horizontal panel members having a telescoping fit allowing adjustment of a length of the respective second elongate panel along a horizontal axis.

23. A column for use in constructing a mine stopping in a mine passage having a roof, a floor, and opposite side ribs, said column comprising:

a column including a column body including a lower column member and an upper column member, the upper column member being extendable relative to the lower column member to bring lower and upper ends of the column body into pressing engagement with the respective floor and roof of the mine passage, and a system associated with the column body constructed to support a plurality of panels extending horizontally between the opposite side ribs of the mine passage, wherein the system comprises a plurality of fasteners connected to the column at vertically spaced apart locations, each of the plurality of fasteners being configured to couple to one of the plurality of panels such that the fastener supports the respective panel at a respective vertical location to extend horizontally between the opposite side ribs of the mine passage.

24. The mine stopping of claim 23, wherein the column comprises at least one vertical support connected to the column body, and a wherein the fasteners are connected to the at least one vertical support for connecting the horizontal panels to the at least one vertical support.

25. The mine stopping of claim 24, wherein the at least one vertical support comprises two elongate members having a telescoping fit allowing extension of the at least one vertical support.

26. The mine stopping of claim 23, wherein the fasteners comprise clamps.

27. A mine stopping installed in a mine passage having a roof, a floor, and opposite first and second side ribs, said mine stopping comprising at least one vertical column extending from the floor to the roof, and a plurality rows of elongate horizontal panels one row above another row supported by the at least one column to extend horizontally between the first and second side ribs to form a wall, said wall of elongate horizontal panels extending substantially completely across the mine passage between the first and second side ribs;

wherein the plurality of rows of horizontal panels comprises a first row and a second row located immediately above the first row, wherein each of the first and second rows have upper and lower longitudinal edge margins, wherein the lower longitudinal edge margin of the second row overlaps the upper longitudinal edge margin of the first row along an overlap section having a height, wherein the lower longitudinal edge margin of the second row and the upper longitudinal edge margin of the first row are slidable with respect to one another to adjust the height of the overlap section.

* * * * *